US011472679B2

(12) United States Patent
Hoshino

(10) Patent No.: US 11,472,679 B2
(45) Date of Patent: Oct. 18, 2022

(54) CRANE

(71) Applicant: SUMITOMO HEAVY INDUSTRIES CONSTRUCTION CRANES CO., LTD., Tokyo (JP)

(72) Inventor: Hiroyuki Hoshino, Aichi (JP)

(73) Assignee: SUMITOMO HEAVY INDUSTRIES CONSTRUCTION CRANES CO., LTD., Tokyo (JP)

( * ) Notice: Subject to any disclaimer, the term of this patent is extended or adjusted under 35 U.S.C. 154(b) by 107 days.

(21) Appl. No.: 16/828,300

(22) Filed: Mar. 24, 2020

(65) Prior Publication Data

US 2020/0307968 A1 Oct. 1, 2020

(30) Foreign Application Priority Data

Mar. 29, 2019 (JP) ..... JP2019-067660

(51) Int. Cl.
*B66C 23/64* (2006.01)
*B66C 13/18* (2006.01)
*B66C 1/02* (2006.01)

(52) U.S. Cl.
CPC ..... *B66C 23/64* (2013.01); *B66C 1/0218* (2013.01); *B66C 13/18* (2013.01)

(58) Field of Classification Search
CPC ..... B66C 13/18; B66C 23/34; B66C 23/88; B66C 23/64
See application file for complete search history.

(56) References Cited

U.S. PATENT DOCUMENTS 3,263,383 A * 8/1966 Foster ..... B66C 23/62 52/143
3,306,470 A * 2/1967 Green ..... B66C 23/70 212/300
3,794,184 A * 2/1974 Higgins ..... B66C 23/34 212/295
7,341,158 B2 3/2008 Toudou et al.
7,455,187 B2 11/2008 Toudou et al.
2005/0150854 A1* 7/2005 Toudou ..... B66C 23/82 212/175
2006/0065616 A1* 3/2006 Diehl ..... B66C 23/82 212/300

(Continued)

FOREIGN PATENT DOCUMENTS

EP 1553043 A2 7/2005
EP 3231762 A1 10/2017

(Continued)

OTHER PUBLICATIONS

JP 2019/031340A Machine Translation. (Year: 2019).*

(Continued)

*Primary Examiner* — Michael R Mansen
*Assistant Examiner* — Juan J Campos, Jr.
(74) *Attorney, Agent, or Firm* — Michael Best & Friedrich LLP

(57) ABSTRACT

There is provided a crane including a main body, a tower derrickably supported by the main body, a jib derrickably supported by the tower, an assist member that assist the jib to move along a ground, and a determination unit that determines whether or not the jib is stopped when the tower is lowered in a lowering work state where the jib is assisted by the assist member.

10 Claims, 10 Drawing Sheets

(56) References Cited

U.S. PATENT DOCUMENTS

| | | | | |
|---|---|---|---|---|
| 2009/0127219 | A1* | 5/2009 | Willim | B66C 23/702 212/300 |
| 2009/0134108 | A1* | 5/2009 | Willim | B66C 23/82 212/270 |
| 2010/0213152 | A1* | 8/2010 | Martin | B66C 23/18 212/177 |
| 2012/0312767 | A1 | 12/2012 | Bohnacker et al. | |
| 2014/0083964 | A1* | 3/2014 | Kurotsu | B66C 23/68 212/177 |
| 2014/0263140 | A1* | 9/2014 | Inada | B66C 23/68 212/177 |
| 2016/0221799 | A1* | 8/2016 | Muench | B66C 13/18 |
| 2017/0275142 | A1* | 9/2017 | Yoda | B66C 23/26 |
| 2019/0185297 | A1* | 6/2019 | Kobatake | B66C 23/82 |

FOREIGN PATENT DOCUMENTS

| | | | | | |
|---|---|---|---|---|---|
| JP | H11-322276 | A | | 11/1999 | |
| JP | 4186822 | B2 | | 11/2008 | |
| JP | 2019006565 | A | | 1/2019 | |
| JP | 2019031340 | A | * | 2/2019 | B66C 23/26 |

OTHER PUBLICATIONS

JP 2019/006565A Machine Translation. (Year: 2019).*
JP 4186822B Machine Translation. (Year: 2008).*
JPH 11322276A Machine Translation. (Year: 1999).*
Search Report issued in European Application No. 20161692.7-1017, dated Aug. 26, 2020.

* cited by examiner

CRANE

RELATED APPLICATIONS

The content of Japanese Patent Application No. 2019-067660, on the basis of which priority benefits are claimed in an accompanying application data sheet, is in its entirety incorporated herein by reference.

BACKGROUND

Technical Field

Certain embodiments of the present invention relate to a crane.

Description of Related Art

The related art discloses a crane including a tower derrickably supported by a vehicle body and a jib derrickably supported by the tower. In the crane, work for removing the jib from the tower is carried out as follows, for example.

The tower is first lowered by unwinding a tower derricking rope in a state where a vehicle wheel attached to a tip of the jib is brought into contact with the ground. In this manner, the tip of the jib is moved forward by the vehicle wheel. Then, when the tower and the jib are parallel to the ground, the tower and the jib are disconnected from each other.

SUMMARY

According to an aspect of the present invention, there is provided a crane including a main body, a tower derrickably supported by the main body, a jib derrickably supported by the tower, an assist member that assist the jib to move along a ground, and a determination unit that determines whether or not the jib is stopped when the tower is lowered in a lowering work state where the jib is assisted by the assist member.

DETAILED DESCRIPTION

While work for lowering the tower is carried out to remove the jib from the tower (hereinafter, referred to as "lowering work"), when the vehicle wheel in the tip of the jib is caught on an obstacle, the tower derricking rope is loosened, and a load applied to the vehicle wheel in the tip of the jib increases.

When the vehicle wheel in the tip of the jib rides across the obstacle due to the load, the tower and the jib are vigorously lowered as much as a loosened amount of the tower derricking rope. As a result, there is a possibility that a configuration component of the crane may be damaged.

It is desirable to provide a crane which prevents a configuration component from being damaged during lowering work.

According to an aspect of the present invention, there is provided a crane including a main body, a tower derrickably supported by the main body, a jib derrickably supported by the tower, an assist member that assist the jib to move along a ground, and a determination unit that determines whether or not the jib is stopped when the tower is lowered in a lowering work state where the jib is assisted by the assist member.

According to the present invention, it is possible to prevent a configuration component from being damaged during lowering work. Problems, configurations, and advantageous effects other than those described above will be clarified in the following description of embodiments.

Figure 1:
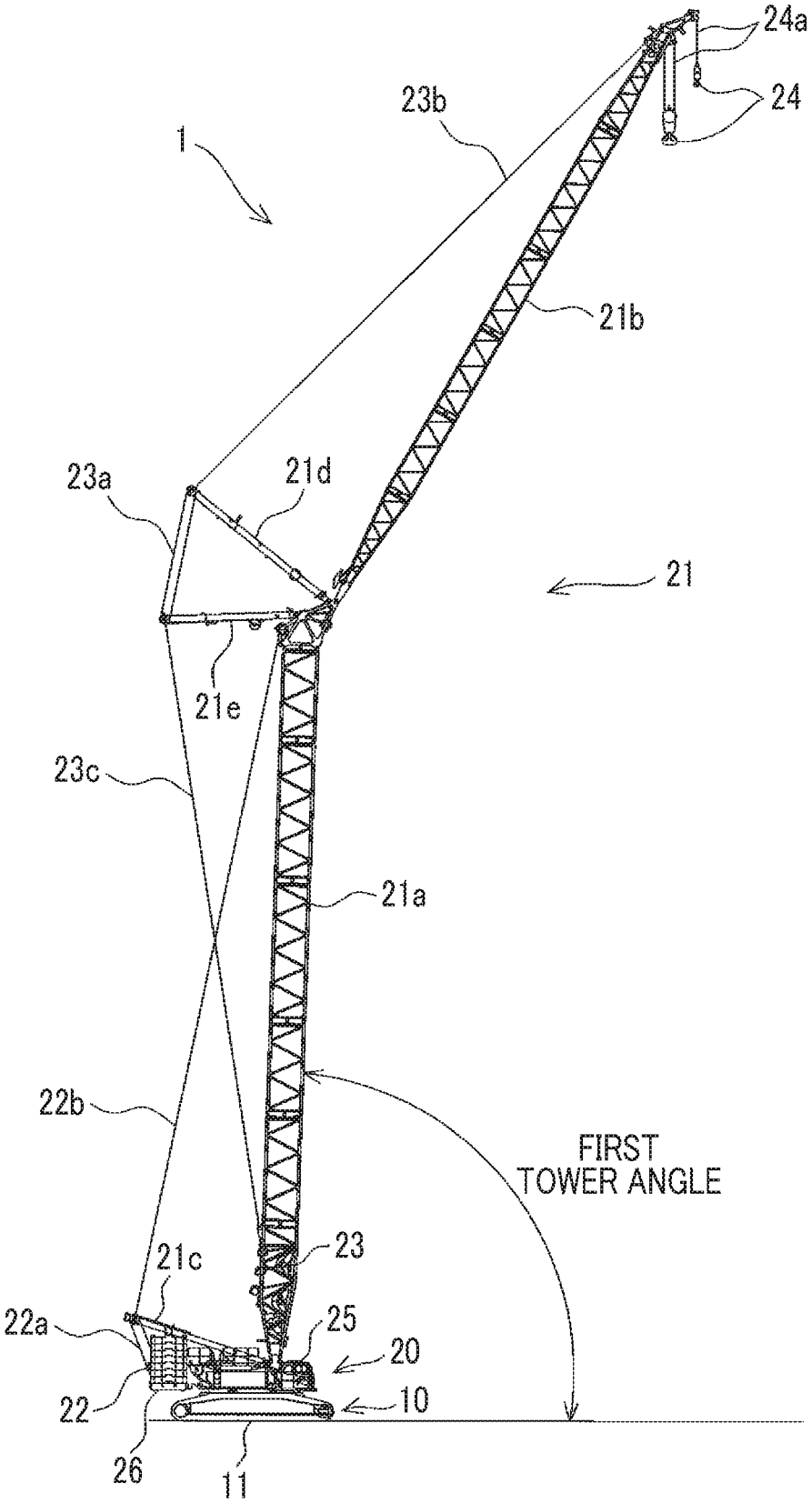
FIG. 1 is a side view of a crawler crane serving as a representative example of a crane.

Hereinafter, an embodiment according to the present invention will be described with reference to the drawings. FIG. 1 is a side view of a crawler crane 1 serving as a representative example of a crane. Unless otherwise specified, forward, rearward, rightward, and leftward directions described in FIG. 1 are based on a viewpoint of an operator who operates the crawler crane 1.

The crawler crane (main body) 1 is configured to include a lower traveling body (crawler) 10 that can travel, and a rotating platform. 20 supported to be turnable by the lower traveling body 10 via a turning bearing (not illustrated). However, the main body may not include one or both of the lower traveling body 10 and the rotating platform 20. That is, the main body may not travel or may not turn.

The lower traveling body 10 includes a pair of caterpillars 11 in both ends in a rightward-leftward direction. A driving force of a hydraulic motor (not illustrated) is transmitted to the caterpillar 11, thereby causing the lower traveling body 10 to travel. The lower traveling body 10 may adopt a wheeled type instead of the caterpillar 11.

The rotating platform 20 supports a front attachment 21 derrickably supported in a front part center of the rotating platform 20, a cabin 25 disposed on a front part left side of the rotating platform 20, an engine (not illustrated) that generates the driving force to operate the crawler crane 1, and a counterweight 26 disposed in a rear part of the rotating platform 20.

The front attachment 21 is configured to include a tower 21*a*, a jib 21*b*, a mast 21*c*, a front post 21*d*, and a rear post 21*e*. A proximal end of the tower 21*a* is supported by a front end of the rotating platform 20, and extends forward and upward of the rotating platform 20. The jib 21*b* is supported by a tip of the tower 21*a*, and extends forward and upward of the rotating platform 20.

The mast 21*c* is pivotably supported by the rotating platform 20, and extends rearward and upward. The front post 21*d* and the rear post 21*e* are pivotably supported by the tip of the tower 21*a*, and extend rearward and upward. However, when the crawler crane 1 carries out suspending work, the rear post 21*e* is fixed to the tower 21*a* at a predetermined angle.

The tower 21*a* performs a derricking operation by using a tower derricking winch (winch) 22. The tower derricking winch 22 is supported by the rotating platform 20, for example. A tower derricking rope 22*a* is wound multiple times between the tower derricking winch 22 and the tip of the mast 21*c*. The tip of the tower 21*a* and the tip of the mast 21*c* are connected to each other by a tower support pendant 22*b*.

When the tower derricking winch 22 is rotated in a winding direction of the tower derricking rope 22*a*, the mast 21*c* is lowered (pivots counterclockwise in FIG. 1). In this manner, the tower 21*a* connected to the mast 21*c* by the tower support pendant 22*b* is raised. On the other hand, when the tower derricking winch 22 is rotated in a unwinding direction of the tower derricking rope 22*a*, the mast 21*c* is raised (pivots clockwise in FIG. 1). In this manner, the tower 21*a* connected to the mast 21*c* by the tower support pendant 22*b* is lowered.

The jib 21*b* performs the derricking operation by using a jib derricking winch 23. The jib derricking winch 23 is disposed in a proximal end portion of the tower 21*a*, for example. The jib derricking rope 23*a* extending from the jib derricking winch 23 is wound multiple times between the tip of the front post 21*d* and the tip of the rear post 21*e*. The tip of the jib 21*b* and the tip of the front post 21*d* are connected to each other by the jib support pendant 23*b*. Furthermore, the tower 21*a* and the tip of the rear post 21*e* are connected to each other by a rear post support pendant 23*c*.

When the jib derricking winch 23 is rotated in the winding direction of the jib derricking rope 23*a*, the front post 21*d* pivots in a direction close to the rear post 21*e* (counterclockwise in FIG. 1). In this manner, the jib 21*b* connected to the front post 21*d* by the jib support pendant 23*b* is raised. On the other hand, when the jib derricking winch 23 is rotated in the unwinding direction of the jib derricking rope 23*a*, the front post 21*d* pivots in a direction away from the rear post 21*e* (clockwise in FIG. 1). In this manner, the jib 21*b* connected to the front post 21*d* by the jib support pendant 23*b* is lowered.

The crawler crane 1 includes a tension sensor 34 that detects tension (hereinafter, referred to as "rope tension T") of the tower derricking rope 22*a*, a tower derricking angle sensor (derricking angle sensor) 35 that detects an angle formed by the tower 21*a* with respect to a horizontal line (hereinafter, referred to as a "tower derricking angle θ"), and a jib derricking angle sensor 36 (refer to FIG. 2) that detects an angle formed by the jib 21*b* with respect to the horizontal line (hereinafter, referred to as a "jib derricking angle"). Each of the sensors 34, 35, and 36 outputs a detection signal which indicates a detection result to a controller 30 (refer to FIG. 2) (to be described later).

Furthermore, a hook 24 is attached to the tip of the hook rope 24*a* suspending from the tip of the jib 21*b*. The hook 24 is raised in such a way that the hook rope 24*a* is wound by a raising and lowering winch (not illustrated), and is lowered in such a way that the hook rope 24*a* is unwound.

The cabin 25 has an internal space on which an operator who operates the crawler crane 1 rides. The internal space of the cabin 25 is provided with operation devices (steering wheel, a pedal, a lever, and a switch) which cause the lower traveling body 10 to travel, causes the rotating platform 20 to turn, causes the tower 21*a* and the jib 21*b* to perform the derricking operation, and receive operations of the operator who raises and lowers the hook 24. That is, the operator who rides on the cabin 25 operates the operation devices, thereby operating the crawler crane 1.

Figure 2:
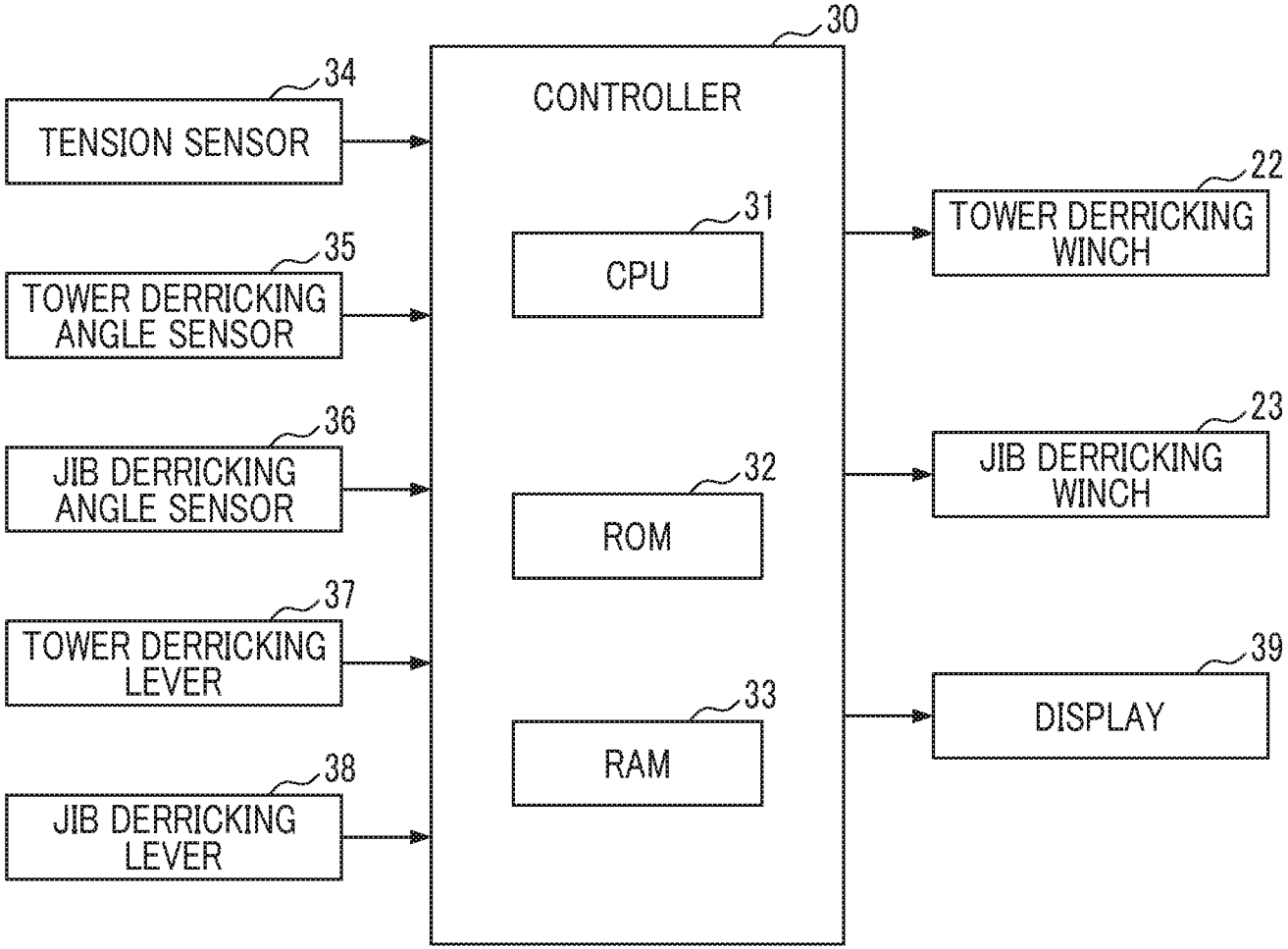
FIG. 2 is a block diagram of a controller mounted on the crawler crane.

The operation devices include at least a tower derricking lever 37 and a jib derricking lever 38 (refer to FIG. 2). The tower derricking lever 37 and the jib derricking lever 38 output an operation signal corresponding to the operation of the operator to the controller 30.

From the operator, the tower derricking lever (operation unit) 37 can receive a "winding operation" for rotating the tower derricking winch 22 in the winding direction of the tower derricking rope 22*a* and a "unwinding operation" for rotating the tower derricking winch 22 in the unwinding direction of the tower derricking rope 22*a*.

From the operator, the jib derricking lever 38 can receive a "winding operation" for rotating the jib derricking winch 23 in the winding direction of the jib derricking rope 23*a* and an "unwinding operation" for rotating the jib derricking winch 23 in the unwinding direction of the jib derricking rope 23*a*.

As an example, in a case where the winches 22 and 23 are rotated by using hydraulic pressure, hydraulic oil corresponding to an operation direction and an operation amount of the levers 37 and 38 is supplied to the winches 22 and 23 through a hydraulic pump (not illustrated). As another example, in a case where the winches 22 and 23 are rotated by using electric power, the electric power corresponding to the operation direction and the operation amount of the levers 37 and 38 is supplied to the winches 22 and 23 through the controller 30.

The counterweight 26 is disposed on a side opposite to the front attachment 21 across a turning center of the rotating platform 20. The counterweight 26 is a weight for weight balance of a load supported by the front attachment 21 (that is, a load suspending from the hook 24). The counterweight 26 can be stacked in an upward-downward direction, and can be increased or decreased in accordance with a weight of the load.

FIG. 2 is a block diagram of the controller 30 mounted on the crawler crane 1. The controller 30 includes a central processing unit (CPU) 31, a read only memory (ROM) 32, and a random access memory (RAM) 33. The CPU 31 reads and executes a program from the ROM 32 and the RAM 33, thereby realizing processes (to be described later).

However, a specific configuration of the controller 30 is not limited to the above-described example as long as the processes described below can be realized. As another example, the controller 30 may realize the processes by using hardware such as an application specific integrated circuit (ASIC) and a field-programmable gate array (FPGA).

The controller 30 according to the present embodiment controls at least one of the tower derricking winch 22, the jib derricking winch 23, and the display 39, based on a detection signal output from the tension sensor 34, the tower derricking angle sensor 35, and the jib derricking angle sensor 36, and an operation signal output from the tower derricking lever 37 and the jib derricking lever 38.

More specifically, the controller 30 acquires the detection signal at a predetermined time interval from the tower derricking angle sensor 35 and the jib derricking angle sensor 36, and causes the display 39 to display a tower derricking angle θ and a tower & jib relative angle, based on the acquired detection signal. The tower & jib relative angle is an angle formed between the tower 21*a* and the jib 21*b*, and can be calculated as (180°−tower derricking angle θ−jib derricking angle). The controller 30 performs a lowering control process (to be described later) with reference to FIG. 3.

Figure 4:
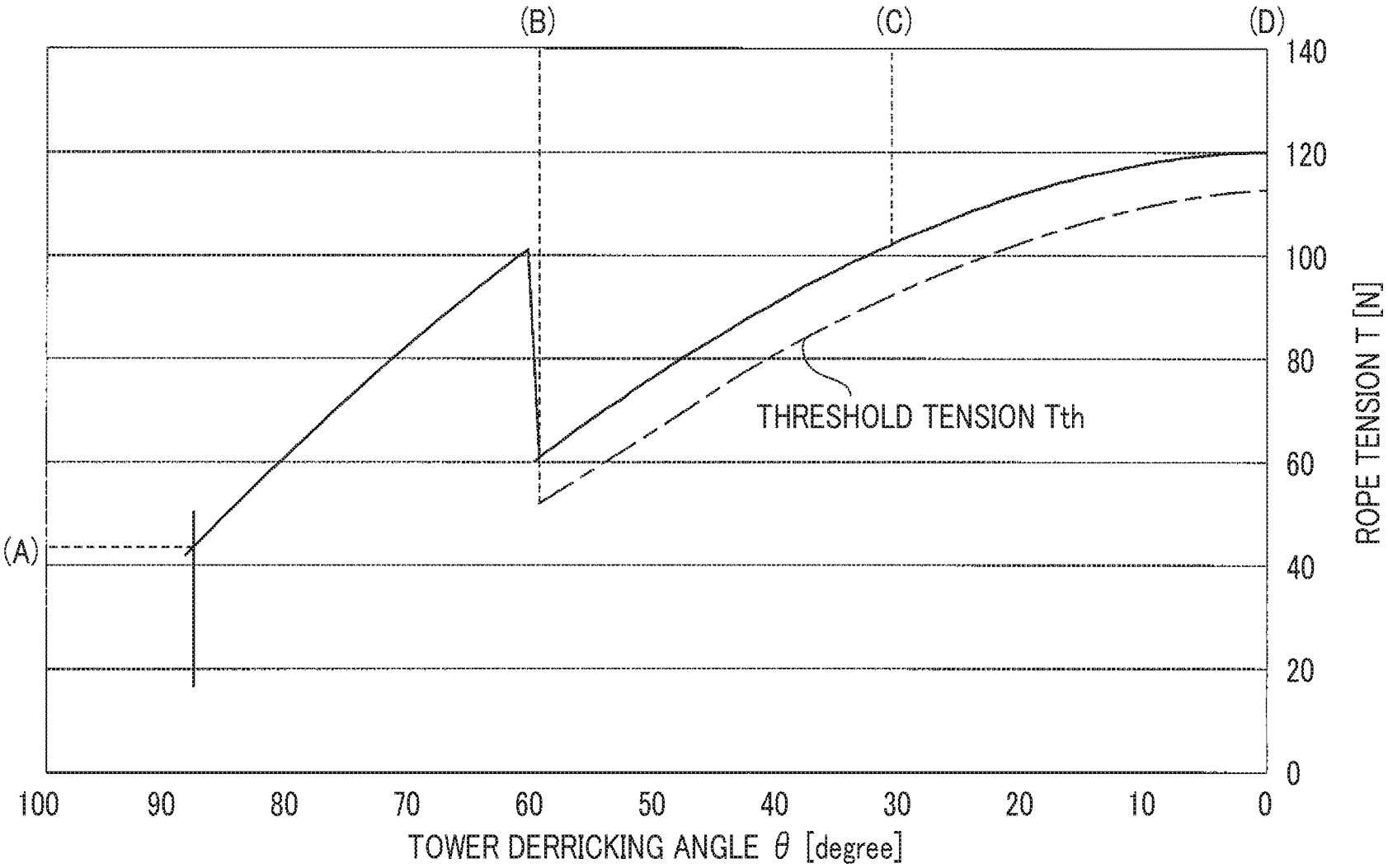
FIG. 4 is a view illustrating a relationship between a tower derricking angle and rope tension in a lowering work state.

A storage unit (ROM 32, RAM 33) stores a threshold tension $T_{th}$. For example, as illustrated in FIG. 4, the threshold tension $T_{th}$ may be a variable value that is changed in response to a change in the tower derricking angle θ. In this case, the storage unit stores a plurality of the threshold tensions $T_{th}$ corresponding to the tower derricking angle θ. For example, the threshold tension $T_{th}$ is set to a value that is several percent to several tens percent lower than an actually measured value or a simulation value of the rope tension T in the lowering control process (to be described later). However, the threshold tension $T_{th}$ may be a fixed value that is not changed in response to the change in the tower derricking angle θ.

The display 39 is a notification device disposed in the cabin 25 so as to notify the operator who rides on the cabin 25 of information. However, a specific example of the notification device is not limited to the display 39 as long as the operator is notified of the information by using a character, an image, a sound, and light. As another example, the notification device may be a speaker that outputs a warning sound or a guide sound, or an LED lamp turned on an off or flickers.

Figure 3:
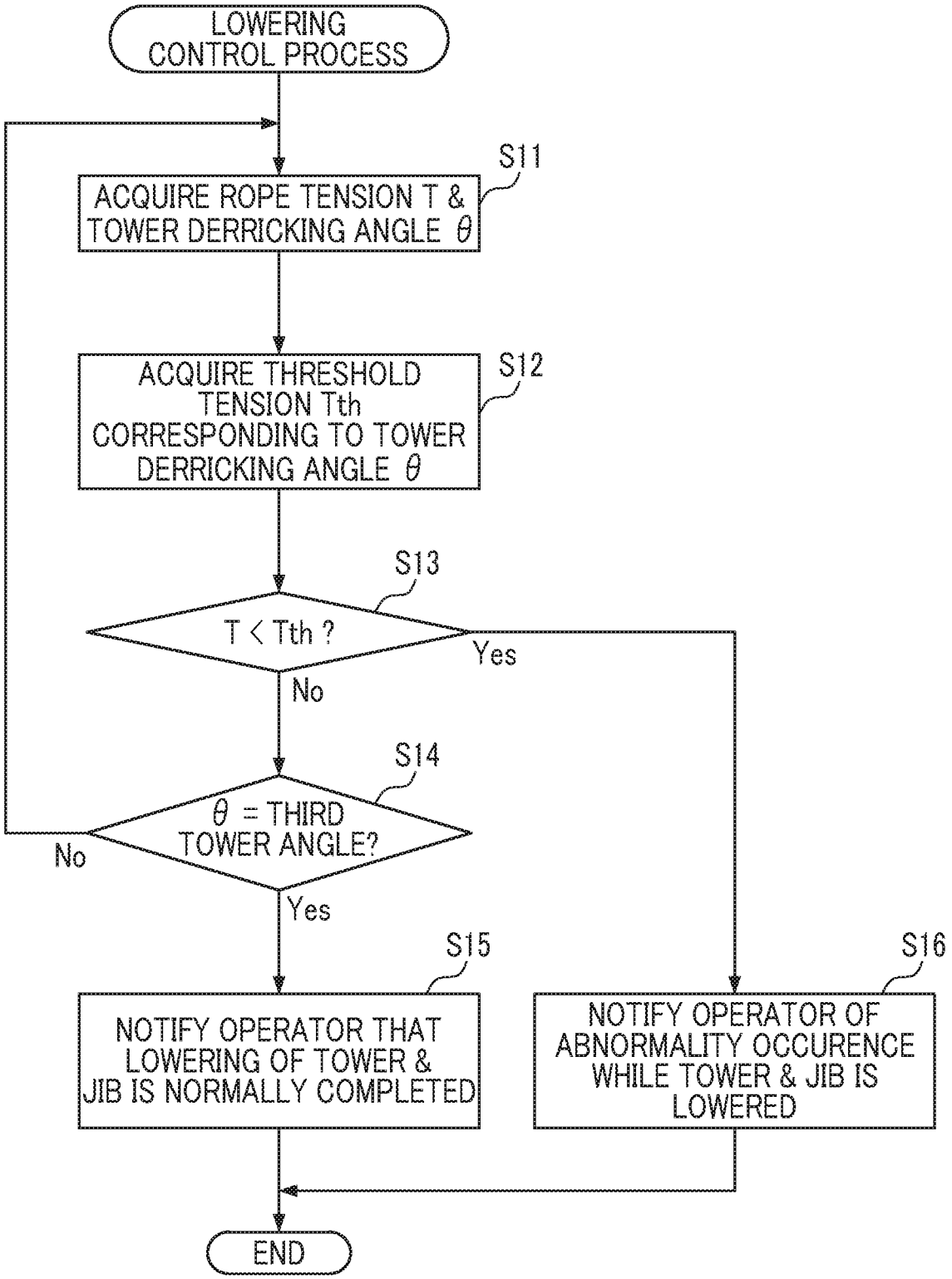
FIG. 3 is a flowchart of a lowering control process.
Figure 5:
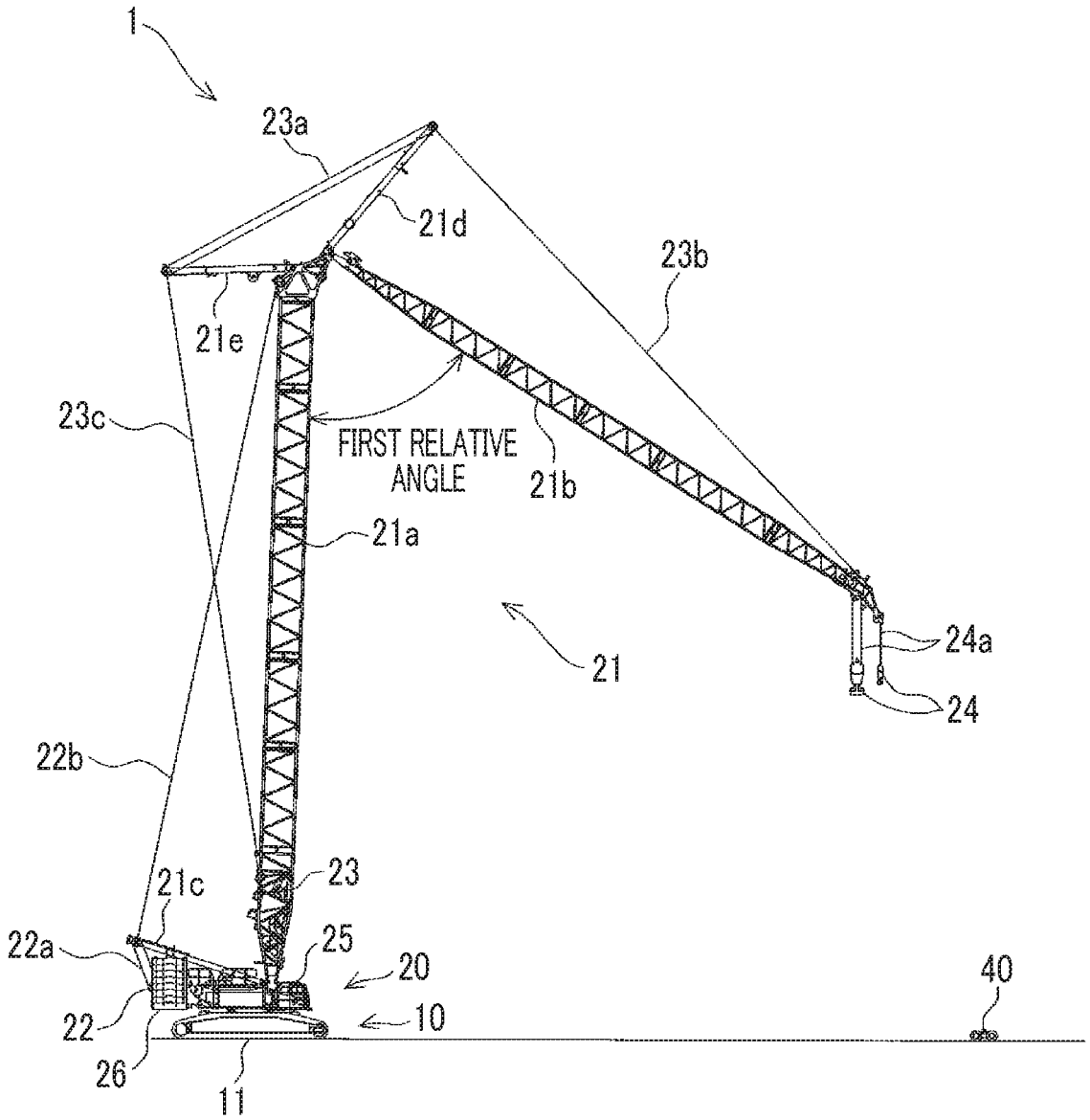
FIG. 5 is a view illustrating a posture of the crawler crane illustrated by (A) in FIG. 4.
Figure 6:
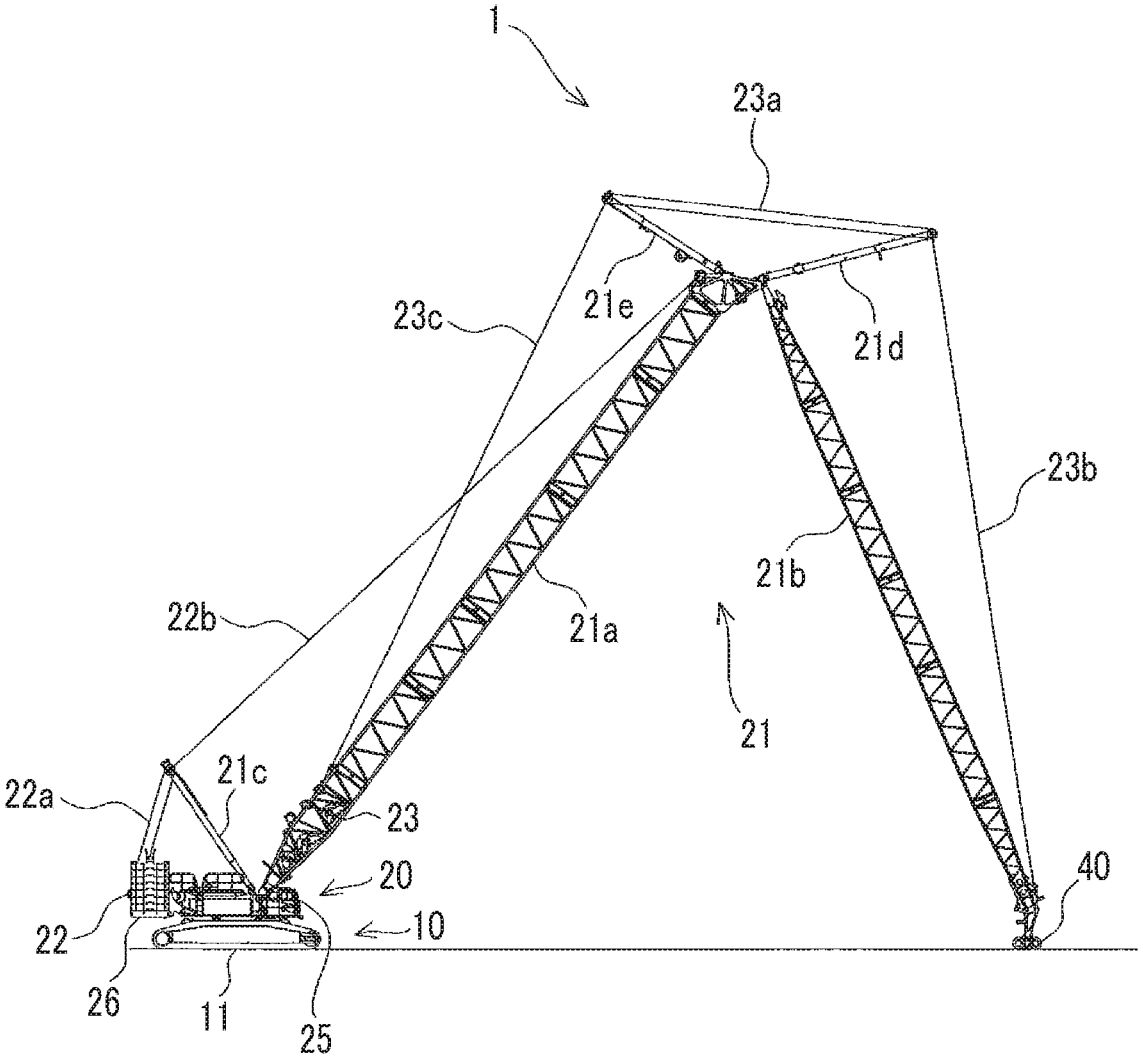
FIG. 6 is a view illustrating a posture of the crawler crane illustrated by (B) in FIG. 4.
Figure 7:
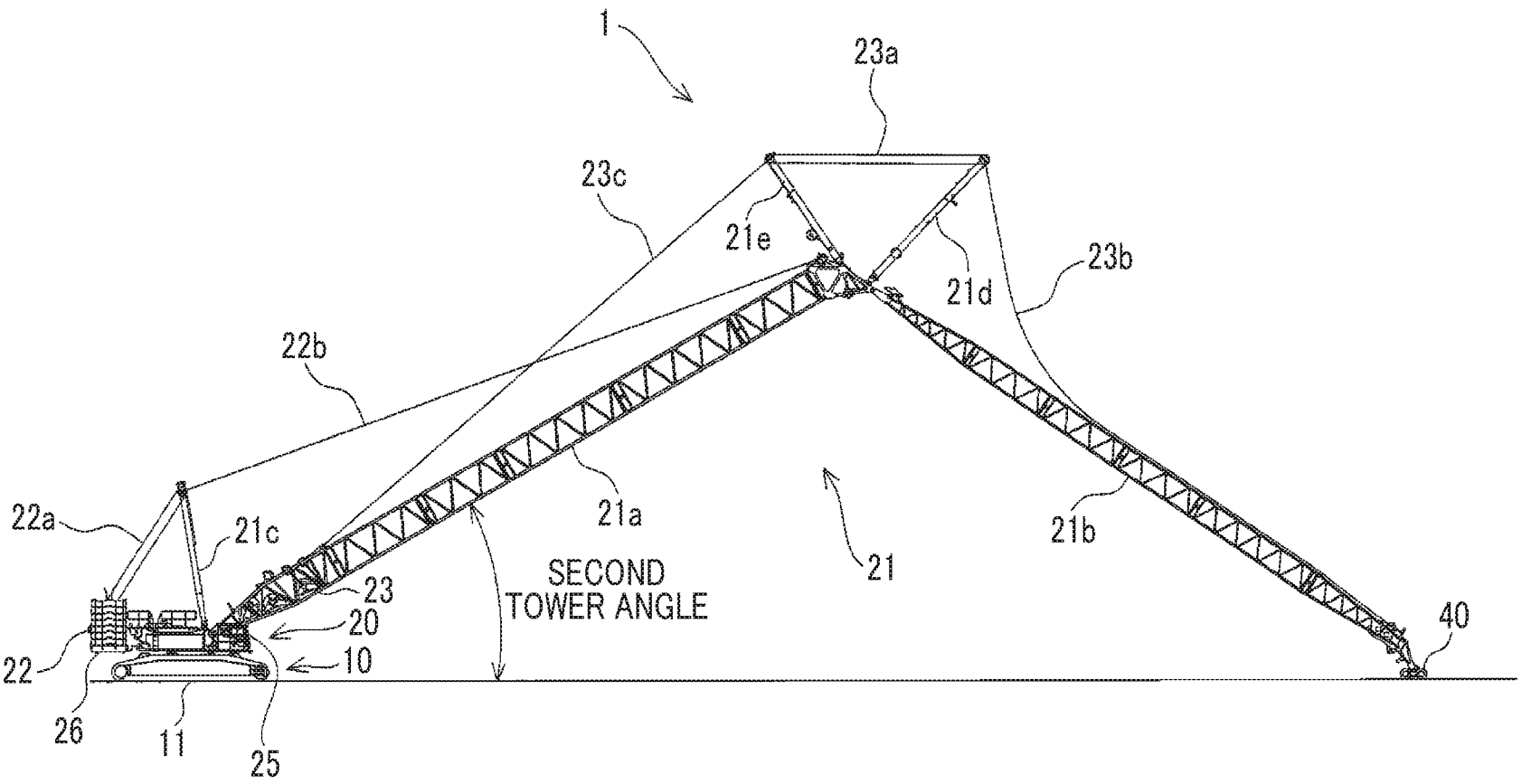
FIG. 7 is a view illustrating a posture of the crawler crane illustrated by (C) in FIG. 4.
Figure 8:
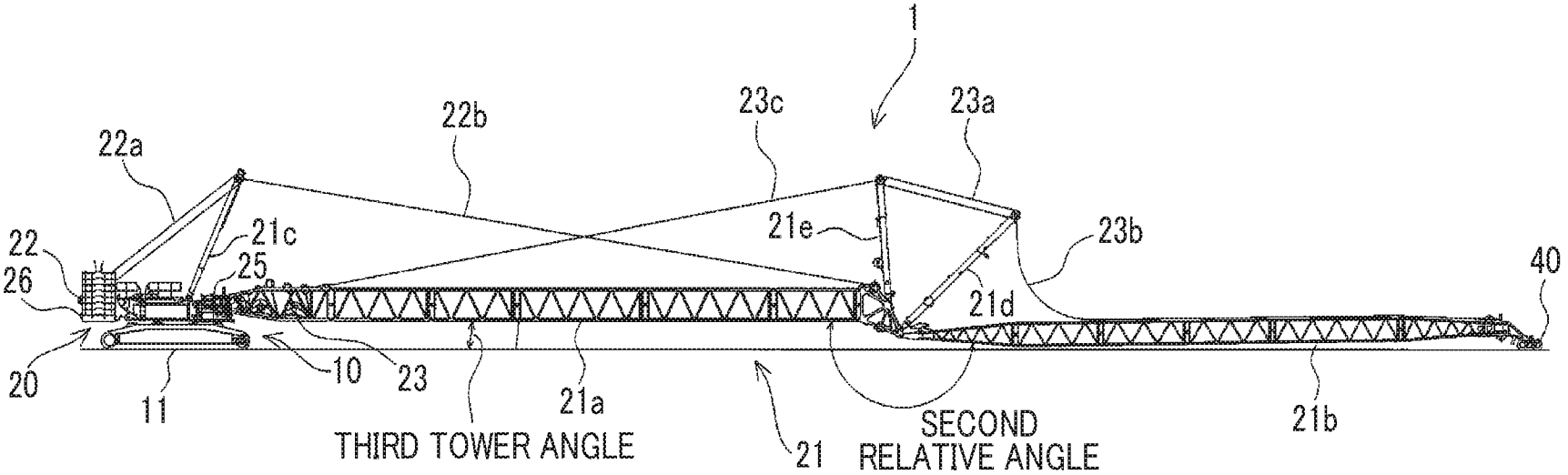
FIG. 8 is a view illustrating a posture of the crawler crane illustrated by (D) in FIG. 4.
Figure 9:
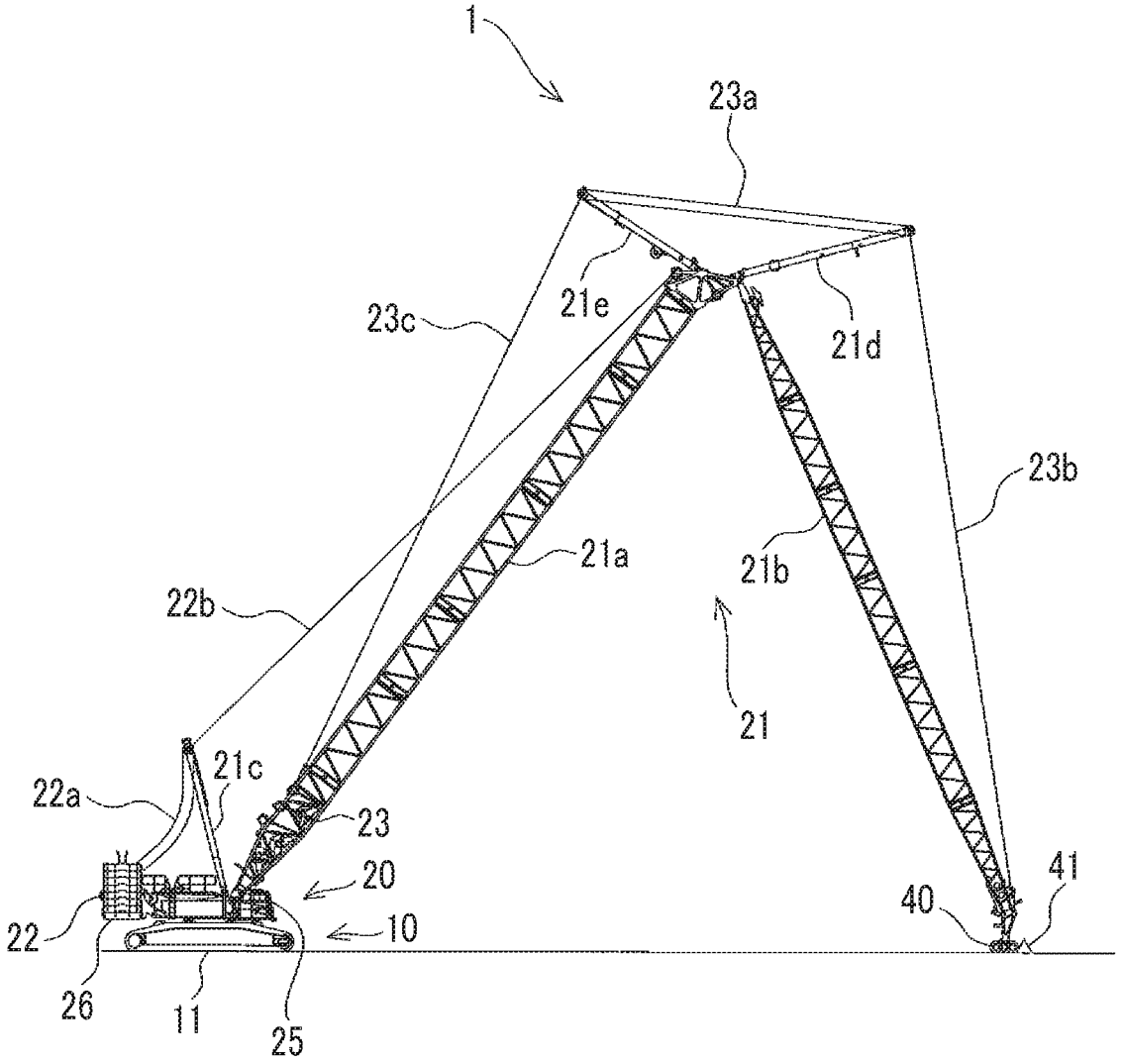
FIG. 9 is a view illustrating a posture of the crawler crane when a bogie is caught on an obstacle.
Figure 10:
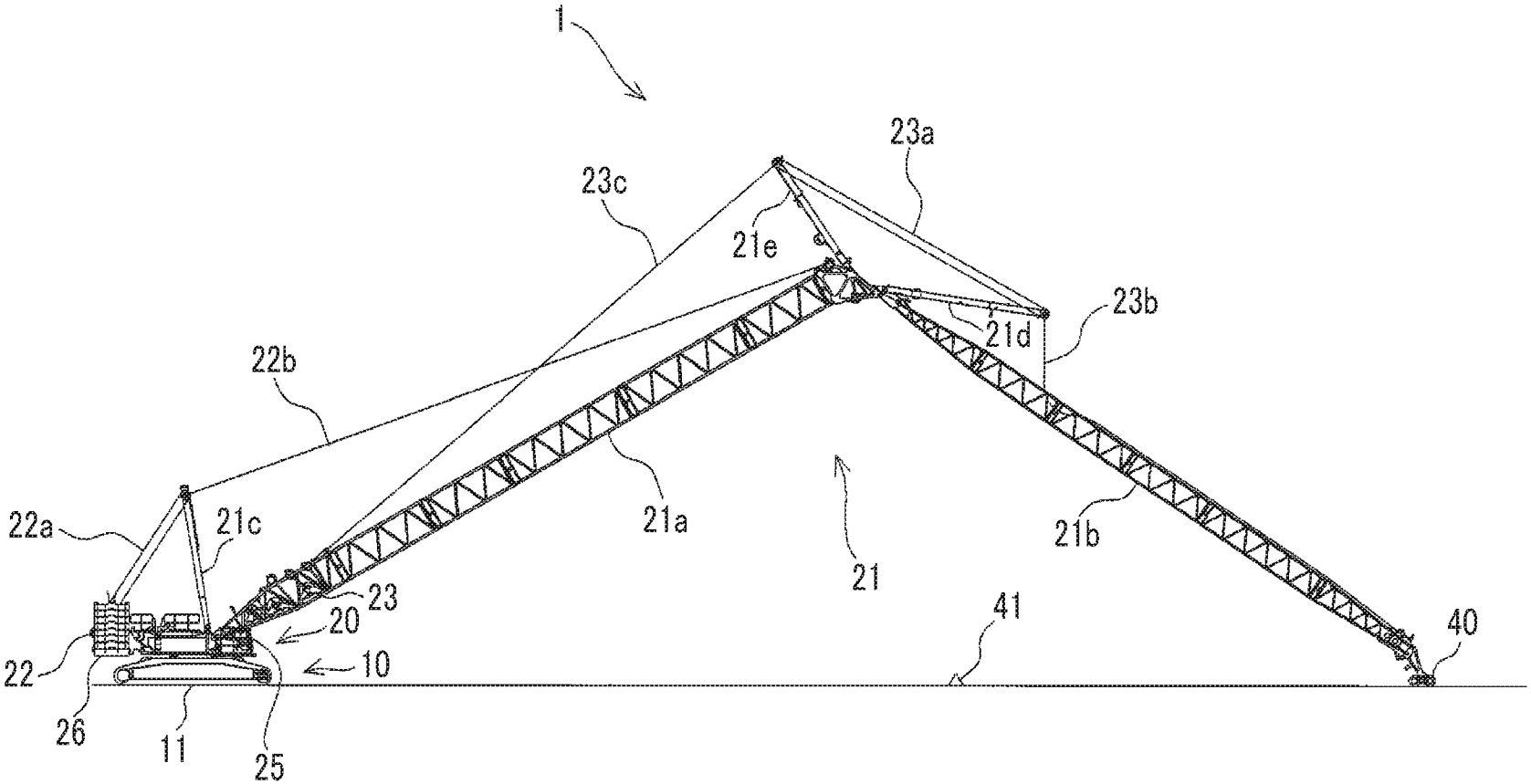
FIG. 10 is a view illustrating a posture of the crawler crane when the bogie rides across the obstacle.

Next, the lowering control process performed by the controller 30 will be described with reference to FIGS. 3 to 10. FIG. 3 is a flowchart of the lowering control process. FIG. 4 is a view illustrating a relationship between the tower derricking angle θ and the rope tension T in a lowering work state. FIG. 5 is a view illustrating a posture of the crawler crane 1 illustrated by (A) in FIG. 4. FIG. 6 is a view illustrating a posture of the crawler crane 1 illustrated by (B) in FIG. 4. FIG. 7 is a view illustrating a posture of the crawler crane 1 illustrated by (C) in FIG. 4. FIG. 8 is a view illustrating a posture of the crawler crane 1 illustrated by (D) in FIG. 4. FIG. 9 is a view illustrating a posture of the crawler crane 1 when a bogie 40 is caught on an obstacle 41. FIG. 10 is a view illustrating a posture of the crawler crane 1 when the bogie 40 rides across the obstacle 41.

In a case where the jib 21*b* is detached from the tower 21*a*, the operator operates the crawler crane 1 in accordance with the following procedure. As illustrated in FIG. 8, the operator needs to lay the tower 21*a* and the jib 21*b* to be substantially horizontal. That is, the operator operates the tower derricking lever 37 and the jib derricking lever 38 while confirming current values of the tower derricking angle θ and the tower & jib relative angle which are displayed on the display 39.

First, the operator performs the winding operation on the tower derricking lever 37, and raises the tower 21*a* until the tower derricking angle θ reaches a first tower angle (for example, 88°) as illustrated in FIG. 1. Next, the operator performs the unwinding operation on the jib derricking lever 38, and lowers the jib 21*b* until the tower & jib relative angle reaches a first relative angle (for example, 60°) as illustrated in FIG. 5.

The crawler crane 1 is configured to be switchable between a work mode and an assembly/disassembly mode. For example, the work mode is a mode selected when the suspending work is carried out. A range in which the tower 21*a* and the jib 21*b* can perform the derricking operation is limited. The assembly/disassembly mode is a mode selected when the tower 21*a* or the jib 21*b* is attached to or detached from the rotating platform 20. The range in which the tower 21*a* and the jib 21*b* can perform the derricking operation is not limited.

Therefore, in the crawler crane 1 during the work mode, when the jib 21*b* is lowered from a state illustrated in FIG. 1, for example, when a derricking angle of the jib 21*b* reaches 15° (that is, the tower & jib relative angle is 103°), a safety device is operated to stop lowering the jib 21*b*.

Therefore, before the jib 21*b* is lowered from the state in FIG. 1 or when the safety device is operated after the derricking angle of the jib 21*b* reaches 15°, the crawler crane 1 needs to switch the crawler crane 1 from the work mode to the assembly/disassembly mode (that is, needs to release the safety device). The modes of the crawler crane 1 may be switched therebetween by the operator who operates the operation devices, or may be automatically switched therebetween by the controller 30.

Here, as illustrated in FIG. 4, when the jib 21*b* is lowered in a state where the tower derricking angle θ is fixed at the first tower angle, the rope tension T gradually increases as the jib 21*b* is lowered. The rope tension T reaches a maximum value when the tower & jib relative angle reaches 90°, and reaches a value of (A) when the tower & jib relative angle reaches the first relative angle.

Next, the operator performs the unwinding operation on the tower derricking lever 37. As illustrated in FIG. 6, the operator lowers the tower 21*a* until the bogie 40 attached to the tip of the jib 21*b* comes into contact with the ground. As an example, the bogie 40 may always be attached to the tip of the jib 21*b*. As another example, the lower of the tower 21*a* may be temporarily stopped immediately before the tip of the jib 21*b* comes into contact with the ground, and the bogie 40 may be attached by detaching the hook 24.

The bogie 40 is an example of an assist member interposed between the tip of the jib 21*b* and the ground so as to assist the tip of the jib 21*b* to move along the ground. For example, the bogie 40 has an adapter that is attachable to and detachable from the tip of the jib 21*b*, and a plurality of vehicle wheels that are rotatably supported by the adapter.

However, a specific example of the assist member is not limited to the bogie 40 as long as the lowering of the tower 21*a* and the jib 21*b* can be assisted. As another example, the assist member may adopt a form of a ski or a sled that slides on the ground. The assist member is not limited to those which come into contact with the ground so as to assist the movement of the jib 21*b*, and may be those which assist the movement of the jib 21*b* by flying in the air.

Here, as illustrated in FIG. 4, when the tower 21*a* is lowered in a state where the tower & jib relative angle is fixed, the rope tension T gradually increases as the tower derricking angle θ decreases. When bogie 40 comes into contact with the ground, the rope tension T rapidly decreases to a value of (B). The tower derricking angle θ when the bogie 40 is in contact with grounded is a second tower angle (for example, 60°).

Next, the operator performs the unwinding operation on the tower derricking lever 37. As illustrated in FIG. 8, the operator lowers the tower 21*a* until the tower derricking angle θ reaches a third tower angle (for example, 0°), or until the tower & jib relative angle reaches the second relative angle (for example, 180°).

As the tower 21*a* is lowered, the operator performs the winding operation on the jib derricking lever 38, and winds the jib derricking rope 23*a* to such an extent that the jib derricking rope 23*a* is not greatly bent and is not tensioned.

The lowering work state means a state where at least the assist member assists the movement. More specifically, the lowering work state means a state where the assist member assists the movement and the tower derricking rope 22*a* is unwound. According to the present embodiment, the following process will be described assuming that the lowering work state is a state where the unwinding operation is performed on the tower derricking lever 37 while the bogie 40 is in contact with the ground.

When the tower 21*a* is lowered in the lowering work state, the tip of the jib 21*b* moves forward (direction away from the crawler crane 1) by the bogie 40 that moves forward as the tower 21*a* is lowered. The front attachment 21 changes postures from the posture illustrated in FIG. 6 ((B) in FIG. 4) to the posture illustrated in FIG. 8 ((D) in FIG. 4) through the posture illustrated in FIG. 7 ((C) in FIG. 4). As illustrated in FIG. 4, the rope tension T gradually increases as the tower derricking angle θ decreases.

On the other hand, as illustrated in FIG. 9, when the bogie 40 cannot move forward by being caught on the obstacle 41, the front attachment 21 is not lowered even when the tower derricking rope 22*a* is unwound. When the operator who does not notice this state continuously performs the unwinding operation on the tower derricking lever 37, the tower derricking rope 22*a* is bent between the mast 21*c* and the tower derricking winch 22. As a result, a force to maintain the posture of the tower 21*a* does not work. Accordingly, a heavy load caused by the weight of the tower 21*a* and the jib 21*b* is applied to the bogie 40.

When a magnitude of the load applied to the bogie 40 exceeds resistance of the obstacle 41, the bogie 40 rides across the obstacle 41 and moves forward. In this case, when the tower derricking rope 22*a* is bent, a force that brakes the forward movement of the bogie 40 does not work. Accordingly, the bogie 40 vigorously moves forward, and suddenly stops when the tower derricking rope 22*a* fully extends. As a result, there is a possibility that configuration components (for example, the rotating platform 20, the tower 21*a*, the jib 21*b*, and the bogie 40) of the crawler crane 1 may be damaged.

The controller 30 starts the lowering control process when the bogie 40 comes into contact with the ground. As an example, the controller 30 may start the lowering control process in a case where the tower & jib relative angle reaches the first relative angle and the tower derricking angle θ reaches the second tower angle. As another example, the controller 30 may start the lowering control process in a case where a decrease amount of the rope tension T per unit time is equal to or larger than a threshold amount (state immediately before (B) in FIG. 4).

First, the controller 30 acquires the rope tension T from the tension sensor 34, and acquires the tower derricking angle θ from the tower derricking angle sensor 35 (S11). Next, from the storage unit, the controller 30 reads the threshold tension $T_{th}$ corresponding to the tower derricking angle θ acquired in the latest Step S11 out of the plurality of threshold tensions $T_{th}$ stored in the storage unit (S12).

The controller 30 compares the rope tension T acquired in Step S11 and the threshold tension $T_{th}$ read in Step S12 with each other (S13). When the bogie 40 is moved forward in the lowering work state, the tower derricking rope 22*a* is continuously tensioned. Therefore, a case where the rope tension T is lower than the threshold tension $T_{th}$ indicates a state where the tower derricking rope 22*a* is bent since the bogie 40 is stopped by being caught on the obstacle 41.

That is, the controller 30 determines whether or not the tip of the jib 21*b* is stopped when the tower 21*a* is lowered in the lowering work state. The controller 30 that performs Step S13 functions as a determination unit.

The controller 30 determines that the tip of the jib 21*b* is moved forward, in a case where the rope tension T is equal to or higher than the threshold tension $T_{th}$ (S13: No). In a case where the controller 30 determines that the tip of the jib 21*b* is moved forward when the tower 21*a* is lowered in the lowering work state (S13: No), the controller 30 compares the tower derricking angle θ acquired in the latest Step S11 and the third tower angle with each other (S14). When the tower derricking angle θ does not reach the third tower angle (S14: No), the controller 30 returns to Step S11, and continues the process.

The controller 30 repeatedly performs Steps S11 to S14 at a predetermined time interval until the rope tension T is lower than the threshold tension $T_{th}$ (S13: Yes) or until the tower derricking angle θ reaches the third tower angle (S14: Yes).

Next, while a state where the rope tension T is equal to or higher than the threshold tension $T_{th}$ is maintained (S13: No), in a case where the tower derricking angle θ reaches the third tower angle (S14: Yes), the controller 30 notifies the operator that the lowering work is normally completed for the tower 21*a* and the jib 21*b*, through the display 39 (S15). On the other hand, in a case where the rope tension T is lower than the threshold tension $T_{th}$ (S13: Yes) until the tower derricking angle θ reaches the third tower angle (S14: No), the controller 30 determines that the tip of the jib 21*b* is stopped.

In a case where the controller 30 determines that the tip of the jib 21*b* is stopped when the tower 21*a* is lowered in the lowering work state (S13: Yes), the controller 30 notifies the operator of abnormality occurrence in the lowering work for the tower 21*a* and the jib 21*b* (S16). The controller 30 that performs the processes in Steps S15 and S16 functions as a notification processing unit.

In Step S16, any process may be performed as long as the operator can recognize the abnormality in the lowering work. For example, the following methods are conceivable. As an example, the controller 30 may cause the display 39 to display a message or an image indicating abnormality occurrence in the lowering work. As another example, the controller 30 may forcibly stop the rotation of the tower derricking winch 22 regardless of the unwinding operation performed on the tower derricking lever 37.

In a case where the tower derricking winch 22 is rotated by using oil pressure, for example, the controller 30 may apply a voltage to an electromagnetic valve (not illustrated) so as to block a hydraulic oil flow path from a hydraulic pump to the tower derricking winch 22. In a case where the tower derricking winch 22 is rotated by using electric power, for example, the controller 30 may stop supplying the electric power to the tower derricking winch 22.

According to the above-described embodiment, for example, the following operation effects are achieved.

According to the above-described embodiment, even though the tower derricking rope 22*a* is unwound in a state where the bogie 40 is in contact with the ground, the operator is notified that the tip of the jib 21*b* is not moved forward. Accordingly, it is possible to prevent the crawler crane 1 from being damaged due the bogie 40 which vigorously moves forward by riding across the obstacle 41.

The first tower angle, the second tower angle, the third tower angle, the first relative angle, and the second relative angle according to the above-described embodiment are values determined by a combination of the lengths of the tower 21*a* and the jib 21*b*, and are stored in the ROM 32 or the RAM 33. For example, the controller 30 may read and use a value corresponding to the combination of the lengths of the tower 21*a* and the jib 21*b* which are input through the operation device.

In the above-described embodiment, an example has been described in which the controller 30 determines that the bogie 40 is in the lowering work state after coming into contact with the ground due to a sudden decrease in the rope tension T ((B) in FIG. 4). However, the embodiment is not limited to the above-described example as long as the controller 30 can determine that the bogie 40 is in contact with the ground. That is, whether the bogie 40 is in contact with the ground can be determined, based on a state of the crawler crane 1 (for example, the rope tension T and the derricking angle of the tower 21*a*), or an image captured by a camera for the bogie 40.

A parameter for determining whether or not the tip of the jib 21*b* is stopped in the lowering work state is not limited to the rope tension T. It is possible to adopt various parameters that are changed as the bogie 40 moves forward.

For example, the crawler crane 1 may include a progress sensor that detects a progress in the lowering work state and a tower sensor that detects a tower movement amount of the tower. For example, the controller 30 may determine that the tip of the jib 21*b* is stopped, in a case where the tower movement amount is smaller than a threshold movement amount when the progress detected by the progress sensor reaches a predetermined point.

As an example, the crawler crane 1 may include a winch sensor that detects a rotation amount of the tower derricking winch 22 (hereinafter, referred to as a "winch rotation amount"). The controller 30 may determine whether the tip of the jib 21*b* is stopped, based on the winch rotation amount and a posture of the front attachment 21. That is, when the posture of the front attachment 21 is not changed although the tower derricking winch 22 is rotated, the controller 30 can determine that the tip of the jib 21*b* is stopped.

More specifically, in Step S11, the controller 30 may acquire the winch rotation amount from the winch sensor, and may acquire the tower derricking angle θ from the tower derricking angle sensor 35. Furthermore, in Step S13, the controller 30 may determine that the tip of jib 21*b* is stopped, in a case where a change amount of the tower derricking angle θ is smaller than a threshold angle when the winch rotation amount reaches a threshold rotation amount (threshold unwinding amount) (S13: Yes).

The winch sensor is an example of a unwinding amount sensor that detects a unwinding amount (hereinafter, referred to as a "rope unwinding amount") of the tower derricking rope 22*a*. However, the unwinding amount sensor is not limited to the winch sensor as long as the rope unwinding amount can be directly or indirectly detected. As another example, the unwinding amount sensor may detect a movement amount of the tower derricking rope 22*a*, or may detect a rotation amount of sheaves attached to the tip of the mast 21*c*, the front post 21*d*, the rear post 21*e*.

The winch sensor is an example of the progress sensor that detects the progress in the lowering work state. That is, the rope unwinding amount is an example of the progress in the lowering work state. However, the progress sensor is not limited to the winch sensor as long as the progress in the lowering work state can be detected. As another example, in a case where the tower 21*a* performs the derricking operation by expanding and contracting a hydraulic cylinder, the progress sensor may detect an expansion and contraction amount of the hydraulic cylinder, or may detect the pressure of the hydraulic oil supplied to the hydraulic cylinder.

The tower derricking angle sensor 35 is an example of the tower sensor that detects the movement amount of the tower 21*a* (hereinafter, referred to as a "tower movement amount"). However, the tower sensor is not limited to the tower derricking angle sensor 35 as long as the tower movement amount can be detected. As another example, the tower sensor may adopt a combination of the tower derricking angle sensor 35 and the jib derricking angle sensor 36.

That is, as another example, in Step S11, the controller 30 may acquire the winch rotation amount from the winch sensor, may acquire the tower derricking angle θ from the tower derricking angle sensor 35, and may acquire the jib derricking angle from the jib derricking angle sensor 36. Furthermore, in Step S13, the controller 30 may determine that the tip of the jib 21*b* is stopped, in a case where the change amount of the tower & jib relative angle is smaller than the threshold angle when the winch rotation amount reaches the threshold rotation amount (S13: Yes).

For example, the crawler crane 1 may include a progress sensor that detects a progress in the lowering work state and a state sensor that detects a state of the assist member. The controller 30 may determine that the tip of the jib 21*b* is stopped, in a case where the assist member is in the specific state when the progress in the lowering work state reaches a predetermined point.

As an example, the crawler crane 1 may include a winch sensor that detects the winch rotation amount and a vehicle wheel sensor that detects a rotation amount of a vehicle wheel included in the bogie 40 (hereinafter, referred to as a "vehicle wheel rotation amount"). The controller 30 may determine whether or not the jib 21*b* is stopped, based on a relationship between the winch rotation amount and the vehicle wheel rotation amount. That is, the controller 30 can determine that the tip of the jib 21*b* is stopped when the vehicle wheels of the bogie 40 are not rotating even though the tower derricking winch 22 is rotating.

More specifically, in Step S11, the controller 30 may acquire the winch rotation amount from the winch sensor, and may acquire the vehicle wheel rotation amount from the vehicle wheel sensor. Furthermore, in Step S13, the controller 30 may determine that the tip of the jib 21*b* is stopped, in a case where the vehicle wheel rotation amount is smaller than a second rotation amount (threshold movement amount) when the winch rotation amount reaches a first rotation amount (predetermined point) (S13: Yes).

The vehicle wheel sensor is an example of the movement amount sensor that detects the movement amount of the assist member. However, the movement amount sensor is not limited to the vehicle wheel sensor as long as the movement amount of the assist member can be detected. As another example, the movement amount sensor may detect the movement amount of the assist member, based on a GPS signal received by a GPS antenna attached to the assist member.

The vehicle wheel sensor is an example of the state sensor that detects a state of the assist member. That is, the vehicle wheel rotation amount is an example of the state of the assist member, and a state where the vehicle wheel rotation amount is smaller than the second rotation amount is an example of the specific state. However, the state sensor is not limited to the vehicle wheel sensor as long as the state of the assist member that is changed between a normal operation and an abnormal operation can be detected when the tower 21*a* is lowered in the lowering work state. As another example, the state sensor may be a load sensor that detects a load applied to the assist member.

That is, as another example, the crawler crane 1 may include the load sensor (for example, a load cell) that detects a load applied to the vehicle wheel of the bogie 40 (hereinafter, referred to as a "vehicle wheel load"). In Step S11, the controller 30 may acquire the winch rotation amount from the winch sensor, and may acquire the vehicle wheel load from the load sensor. Furthermore, in Step S13, the controller 30 may determine that the tip of the jib 21*b* is stopped, in a case of the specific state where the vehicle wheel load is equal to or greater than a threshold load when the winch rotation amount reaches the first rotation amount (predetermined point) (S13: Yes).

In the above-described embodiment, an example has been described in which the state where the bogie 40 is in contact with the ground and the tower derricking rope 22*a* is unwound is referred to as the "lowering work state". However, a specific example of the lowering work state is not limited thereto as long as the assist member assists the movement in a state where the work for lowering at least the tower 21*a* and the jib 21*b* is sufficiently prepared. As another example, in a case where the assist member flies in the air, the lowering work state may be a state where the assist member starts to fly.

In the above-described embodiment, an example has been described in which the tower 21*a* is lowered by operating the tower derricking lever 37. However, the embodiment is not limited to the above-described example as long as the tower 21*a* can be lowered. As another example, the controller 30 automatically carry out the lowering work by determining that the operator operates the operation unit which instructs to carry out the lowering work, or determining that a predetermined condition (for example, a lapse of a set time) is satisfied. In this manner, the controller 30 may bring the tower 21*a* into the lowering work state, and may determine the abnormality when the tower 21*a* is automatically lowered.

The controller 30 which automatically carries out the lowering work rotates the tower derricking winch 22 in the winding direction of the tower derricking rope 22*a* until the tower derricking angle θ acquired from the tower derricking angle sensor 35 reaches the first tower angle. Next, the controller 30 rotates the jib derricking winch 23 in the unwinding direction of the jib derricking rope 23*a* until the tower & jib relative angle acquired from the tower derricking angle sensor 35 and the jib derricking angle sensor 36 reaches the first relative angle. Next, the controller 30 rotates the tower derricking winch 22 in the unwinding direction of the tower derricking rope 22*a* until the tower derricking angle θ acquired from the tower derricking angle sensor 35 reaches the second tower angle. In this manner, the bogie 40 is brought into contact with the ground.

Next, the controller 30 rotates the tower derricking winch 22 in the unwinding direction of the tower derricking rope 22*a* in a state where the bogie 40 is in contact with the ground, until the tower derricking angle θ acquired from the tower derricking angle sensor 35 reaches the third tower angle. The controller 30 performs the lowering control process in a process (that is, the lowering work state) in which the tower derricking angle θ is changed from the second tower angle to the third tower angle. The controller 30 may forcibly stop the tower derricking winch 22 in a case where the controller 30 determines that the tip of the jib 21*b* is stopped (S13: Yes), when the tower 21*a* is lowered in the lowering work state (S16).

The lowering control process is applicable not only to a case of detecting that the bogie 40 is caught on the obstacle 41 in a state where the bogie 40 in contact with the ground, but also to a case where the bogie 40 is caught on the obstacle 41 in the air before the bogie 40 comes into contact with the ground. Furthermore, in the lowering control process, the controller 30 may not only detect the abnormality that "the tip of the jib 21*b* is stopped when the tower 21*a* is lowered in the lowering work state", but also may detect the abnormality that the whole crawler crane 1 is in a state close to the state illustrated in FIG. 8 although the tip of the jib 21*b* is moved.

The present invention is not limited to the above-described embodiments, and can be modified in various ways within the scope not departing from the concept of the present invention. All technical matters included in the technical idea described in the appended claims are defined as subject matters of the present invention. The above-described embodiments are merely preferred examples. Those skilled in the art can realize various alternative examples, correction examples, modification examples, or improvement examples from the content disclosed herein. These examples are included in the technical scope disclosed in the appended claims.

It should be understood that the invention is not limited to the above-described embodiment, but may be modified into various forms on the basis of the spirit of the invention. Additionally, the modifications are included in the scope of the invention.

What is claimed is:

1. A crane comprising:

a main body;

a tower derrickably supported by the main body;

a jib derrickably supported by the tower;

an assist member that assists the jib to move along a ground; and a determination unit that determines whether or not the jib is stopped when the tower is lowered in a lowering work state where the jib is assisted by the assist member, wherein the determination unit determines that the jib is stopped, in a case where the jib is stopped by an obstacle when the tower is lowered in the lowering work state.

2. The crane according to claim 1, further comprising:

a progress sensor that detects a progress in the lowering work state; and a tower sensor that detects a tower movement amount of the tower, wherein the determination unit determines that the jib is stopped, in a case where the tower movement amount is smaller than a threshold movement amount when the progress detected by the progress sensor reaches a predetermined point in the lowering work state.

3. The crane according to claim 2, further comprising:

a winch that raises the tower by winding a rope and lowers the tower by unwinding the rope, wherein the progress sensor is a unwinding amount sensor that detects a rope unwinding amount of the rope, wherein the tower sensor is a derricking angle sensor that detects a tower derricking angle of the tower, and wherein the determination unit determines that the jib is stopped, in a case where a change amount of the tower derricking angle is smaller than a threshold angle when the rope unwinding amount reaches a threshold unwinding amount in the lowering work state.

4. The crane according to claim 1, further comprising:

a progress sensor that detects a progress in the lowering work state; and a state sensor that detects a state of the assist member, wherein the determination unit determines that the jib is stopped, in a case where the assist member is in a specific state when the progress in the lowering work state reaches a predetermined point.

5. The crane according to claim 4, further comprising:

a winch that raises the tower by winding a rope and lowers the tower by unwinding the rope, wherein the progress sensor is a unwinding amount sensor that detects a rope unwinding amount of the rope, wherein the state sensor is a movement amount sensor that detects a movement amount of the assist member, and wherein the determination unit determines that the jib is stopped, in a case where the movement amount of the assist member is smaller than a threshold movement amount when the rope unwinding amount reaches a threshold unwinding amount in the lowering work state.

6. The crane according to claim 4, further comprising:

a winch that raises the tower by winding a rope and lowers the tower by unwinding the rope, wherein the progress sensor is a unwinding amount sensor that detects a rope unwinding amount of the rope, wherein the state sensor is a load sensor that detects a load applied to the assist member, and wherein the determination unit determines that the jib is stopped, in a case of the specific state where the load applied to the assist member is equal to or greater than a threshold when the rope unwinding amount reaches a threshold unwinding amount in the lowering work state.

7. The crane according to claim 1, further comprising:

a notification processing unit that notifies an operator of an abnormality in lowering work, in a case where the determination unit determines that the jib is stopped.

8. A crane comprising:

a main body;

a tower derrickably supported by the main body;

a jib derrickably supported by the tower;

an assist member that assists the jib to move along a ground;

a determination unit that determines whether or not the jib is stopped when the tower is lowered in a lowering work state where the jib is assisted by the assist member;

a winch that raises the tower by winding a rope and lowers the tower by unwinding the rope; and a tension sensor that detects a rope tension applied to the rope, wherein the lowering work state is a state where the jib is assisted by the assist member and the rope is unwound, and wherein the determination unit determines that the jib is stopped, in a case where the rope tension falls below a threshold tension in the lowering work state.

9. The crane according to claim 8, further comprising:

a derricking angle sensor that detects a tower derricking angle of the tower, wherein the determination unit determines that the jib is stopped, in a case where the rope tension falls below the threshold tension corresponding to the current tower derricking angle in the lowering work state.

10. A crane comprising:

a main body;

a tower derrickably supported by the main body;

a jib derrickably supported by the tower;

an assist member that assists the jib to move along a ground;

a winch that raises the tower by winding a rope and lowers the tower by unwinding the rope; and a determination unit that determines whether or not the jib is stopped when the tower is lowered and the rope is loosened in a lowering work state where the jib is assisted by the assist member.

* * * * *